US006960140B2

(12) United States Patent
Solheim et al.

(10) Patent No.: US 6,960,140 B2
(45) **Date of Patent: *Nov. 1, 2005**

(54) GOLF PUTTER HEAD WITH A VISUAL ALIGNMENT AID AND AN INCREASED MOMENT OF INERTIA

(75) Inventors: John A. Solheim, Phoenix, AZ (US); David D. Jones, Glendale, AZ (US); Derek W. Haines, Cave Creek, AZ (US); John K. Solheim, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/758,654

(22) Filed: Jan. 15, 2004

(65) Prior Publication Data

US 2005/0159240 A1 Jul. 21, 2005

(51) Int. Cl.[7] ..... A63B 53/04; A63B 69/36

(52) U.S. Cl. ..... 473/251; 473/340; D21/736; D21/742

(58) Field of Search ..... 473/324–350, 473/251–256; D21/736–746, 759

(56) References Cited

U.S. PATENT DOCUMENTS

| | | | | | |
|---|---|---|---|---|---|
| D58,209 | S | | 6/1921 | Bacheller | |
| D163,083 | S | | 5/1951 | Belline | |
| 2,954,231 | A | | 9/1960 | MacIntyre | |
| D218,178 | S | * | 7/1970 | Solheim | D21/739 |
| D230,869 | S | | 3/1974 | Winter | |
| D234,960 | S | | 4/1975 | Swash | |
| D235,668 | S | | 7/1975 | Swash | |
| D238,285 | S | * | 12/1975 | Ross | D21/739 |
| 4,010,958 | A | | 3/1977 | Long | |
| D255,373 | S | * | 6/1980 | Solheim | D21/743 |
| 4,444,395 | A | | 4/1984 | Reiss | |
| D282,952 | S | | 3/1986 | Mattingly | |
| 4,688,798 | A | | 8/1987 | Pelz | |
| 4,815,739 | A | | 3/1989 | Donica | |
| 5,058,895 | A | | 10/1991 | Igarashi | |
| 5,116,047 | A | | 5/1992 | Phelan | |

(Continued)

*Primary Examiner*—Sebastiano Passaniti
(74) *Attorney, Agent, or Firm*—Darrell F. Marquette

(57) ABSTRACT

A golf putter head includes a face member with a front surface arranged for impacting a golf ball. A first arm extends substantially rearwardly from a heel end of the face member, a second arm extends substantially rearwardly from a toe end of the face member, and a central member extends rearwardly from the face member intermediate the heel and toe ends thereof. The central member is connected to the first and second arms rearwardly of the face member. A first cavity is formed in an upper surface of the central member between the first and second openings, and a second cavity is formed in the upper surface of the central member rearwardly of the first cavity and rearwardly of the first and second openings. First and second inserts are disposed, respectively, in the first and second cavities. The first cavity and the first insert each have a generally elongated crescent shape with a concave end while the second cavity and the second insert each have a generally semicircular shape with a convex side. In order to provide a visual alignment aid, the convex sides of the second cavity and the second insert are aligned with and complement the concave ends of the first cavity and the first insert. The first and second inserts have a color which contrasts with the face member, the first and second arms, and the central member to enhance the visual alignment aid.

22 Claims, 2 Drawing Sheets

U.S. PATENT DOCUMENTS 5,160,141 A 11/1992 Crews
D334,039 S 3/1993 Tanaka
5,213,332 A 5/1993 Fahy et al.
D341,405 S * 11/1993 Solheim ..... D21/743
5,482,281 A 1/1996 Anderson
D379,484 S * 5/1997 Solheim ..... D21/745
5,630,765 A 5/1997 Moore
D380,029 S * 6/1997 Anderson ..... D21/745
5,749,791 A 5/1998 Passeri
D399,911 S * 10/1998 Nicolette et al. ..... D21/736
5,830,078 A 11/1998 McMahan
D402,722 S 12/1998 Rollinson
5,842,935 A 12/1998 Nelson
D405,137 S * 2/1999 Nelson ..... D21/738
5,871,407 A * 2/1999 Tseng ..... 473/328
D410,717 S * 6/1999 Anderson ..... D21/738
D411,271 S * 6/1999 Nelson ..... D21/738
5,916,035 A * 6/1999 Caiozzo ..... 473/252
6,017,280 A 1/2000 Hubert
6,059,669 A 5/2000 Pearce
6,080,070 A 6/2000 Whitley
D437,017 S 1/2001 Ford
D444,833 S * 7/2001 Wells et al. ..... D21/743
D449,865 S * 10/2001 Fife et al. ..... D21/736
D451,973 S * 12/2001 Wells et al. ..... D21/743
6,350,208 B1 2/2002 Ford
D460,990 S 7/2002 Jung
D461,860 S * 8/2002 Tang ..... D21/742
6,471,600 B2 10/2002 Tang
D472,949 S * 4/2003 Serrano ..... D21/736
D474,821 S * 5/2003 Wells et al. ..... D21/743
D484,935 S * 1/2004 Tang ..... D21/738
D485,321 S * 1/2004 Breier et al. ..... D21/738
D488,526 S 4/2004 Souza et al.
D493,857 S 8/2004 Cameron
D496,417 S 9/2004 Tang
D496,418 S 9/2004 Tang
6,796,911 B2 9/2004 Grace
D499,778 S 12/2004 Cameron
D500,109 S * 12/2004 Solheim et al. ..... D21/736
D500,110 S * 12/2004 Solheim et al. ..... D21/742
6,837,801 B1 1/2005 Souza et al.

* cited by examiner 10
26
24
12
54
58
18
14
16
10a
10b
42
50
44
32
60
62
33
35
36
34
36a
52
38
46
40
48
10c
37

10
12
18
24
16
14
10b
44
36
42
10a
34
32
38
40
10c
37

GOLF PUTTER HEAD WITH A VISUAL ALIGNMENT AID AND AN INCREASED MOMENT OF INERTIA

BACKGROUND OF THE INVENTION

This invention relates generally to golf equipment and, in particular, to a golf putter head with a visual alignment aid and an increased moment of inertia.

Recent developments in golf equipment have resulted in golf putter heads with high moments of inertia. For example, U.S. Pat. No. 5,482,281 to D. W. Anderson discloses a putter head sold under the name DANSER. The Anderson putter head has heel and toe weights mounted on a lower plate-like member. The heel and toe weights and the lower plate-like member are preferably made of heavyweight material such as bronze or steel. An upper shell-like member, preferably made of lightweight material such as plastic or aluminum, is secured to the lower plate-like material to enclose the heel and toe weights. U.S. Pat. No. 5,842,935 to M. J. Nelson discloses a putter head sold under the name NELLI. The Nelson putter head has a horseshoe shaped body formed of high density material such as steel with thickened heel and toe portions. The horseshoe shaped body includes a cavity which receives an insert formed of low density material such as polyurethane. The insert preferably constitutes about 15% of the total weight of the putter head while constituting more than 50% of the total volume of the putter head.

SUMMARY OF THE INVENTION

The present invention provides a golf putter head including a face member having a heel end, a toe end, a top rail, a front surface arranged for impacting a golf ball, and a back surface. A first arm extends substantially rearwardly from the heel end of the face member, and a second arm extends substantially rearwardly from the toe end of the face member. A central member extends rearwardly from the face member intermediate the heel and toe ends thereof. The central member is connected to the first and second arms rearwardly of the face member. The central member and the first arm define a first opening therebetween adjacent the heel end of the face member while the central member and the second arm define a second opening therebetween adjacent the toe end of the face member. A first cavity is formed in an upper surface of the central member between the first and second openings, and a second cavity is formed in the upper surface of the central member rearwardly of the first cavity and rearwardly of the first and second openings.

The first cavity preferably has a generally elongated crescent shape with a concave end while the second cavity preferably has a generally semicircular shape with a convex side. The convex side of the second cavity is aligned with and complements the concave end of the first cavity to provide a visual alignment aid. A first insert having a generally elongated crescent shape with a concave end is disposed in the first cavity, and a second insert having a generally semicircular shape with a convex side is disposed in the second cavity. The convex side of the second insert is aligned with and complements the concave end of the first insert.

The central member includes a substantially U-shaped wall at one end thereof that merges with the back surface of the face member. The substantially U-shaped wall has a top edge, and a middle portion of the wall top edge protrudes above the top rail of the face member. The wall top edge has opposed side portions which slope downwardly from the middle portion as the wall extends away from the face member. The first and second arms have top surfaces that slope downwardly as the first and second arms extend away from the face member, and the central member has a thickened portion at the other end thereof opposite the wall.

DESCRIPTION OF THE PREFERRED EMBODIMENT

Figure 1:
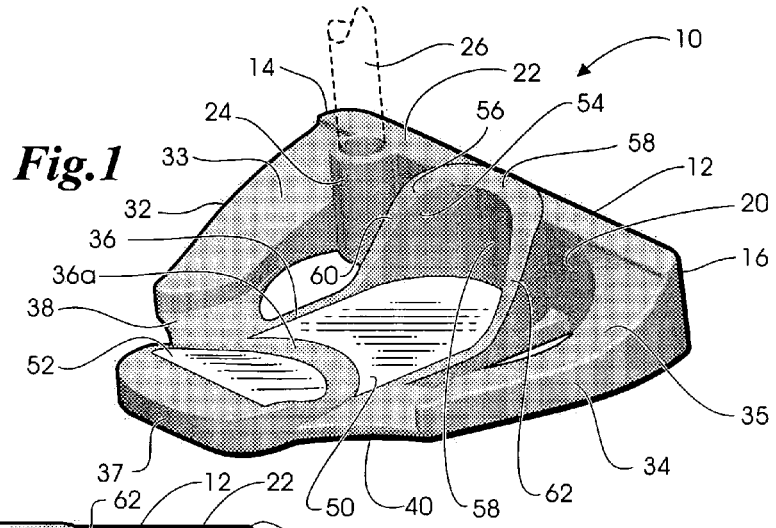
FIG. 1 is a perspective view of a golf putter head according to the preferred embodiment of the present invention.
Figure 2:
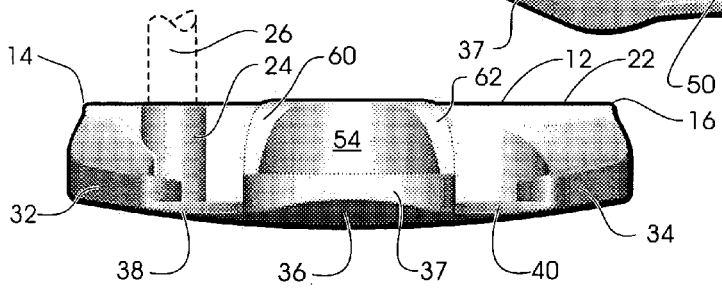
FIG. 2 is a rear elevational view of the golf putter head shown in FIG. 1.
Figure 3:
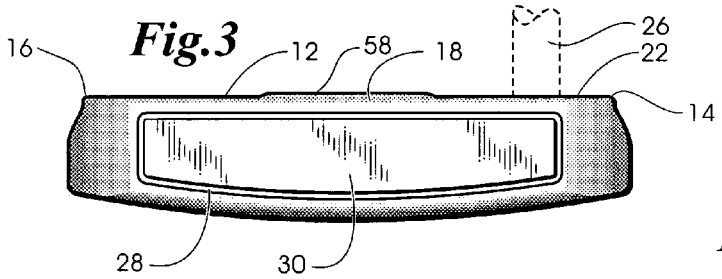
FIG. 3 is a front elevational view of the golf putter head shown in FIG. 1.
Figure 4:
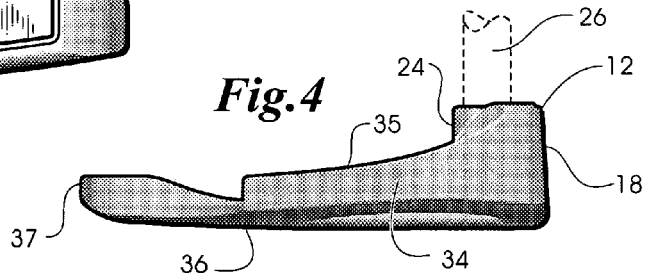
FIG. 4 is a toe end view of the golf putter head shown in FIG. 1.
Figure 5:
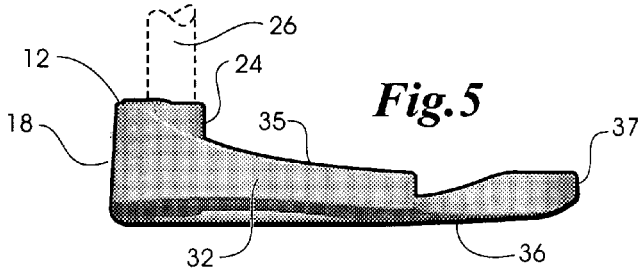
FIG. 5 is a heel end view of the golf putter head shown in FIG. 1.

Referring to FIGS. 1–3, a golf putter head 10 includes a face member 12 with a heel end 14, a toe end 16, a front surface 18 arranged for impacting a golf ball, a back surface 20 and a top rail 22. A hosel 24 is disposed near the heel end 14 of the face member 12. A shaft 26 has its lower end received in the hosel 24 and fixed therein by a suitable adhesive. As disclosed in U.S. patent application Ser. No. 10/632,580 filed Jul. 31, 2003 and incorporated herein by reference, the front surface 18 of the face member 12 has a recess 28 formed therein, and a face plate 30, preferably made of an elastomeric material such as polyurethane, is disposed in the recess 28.

Figure 6:
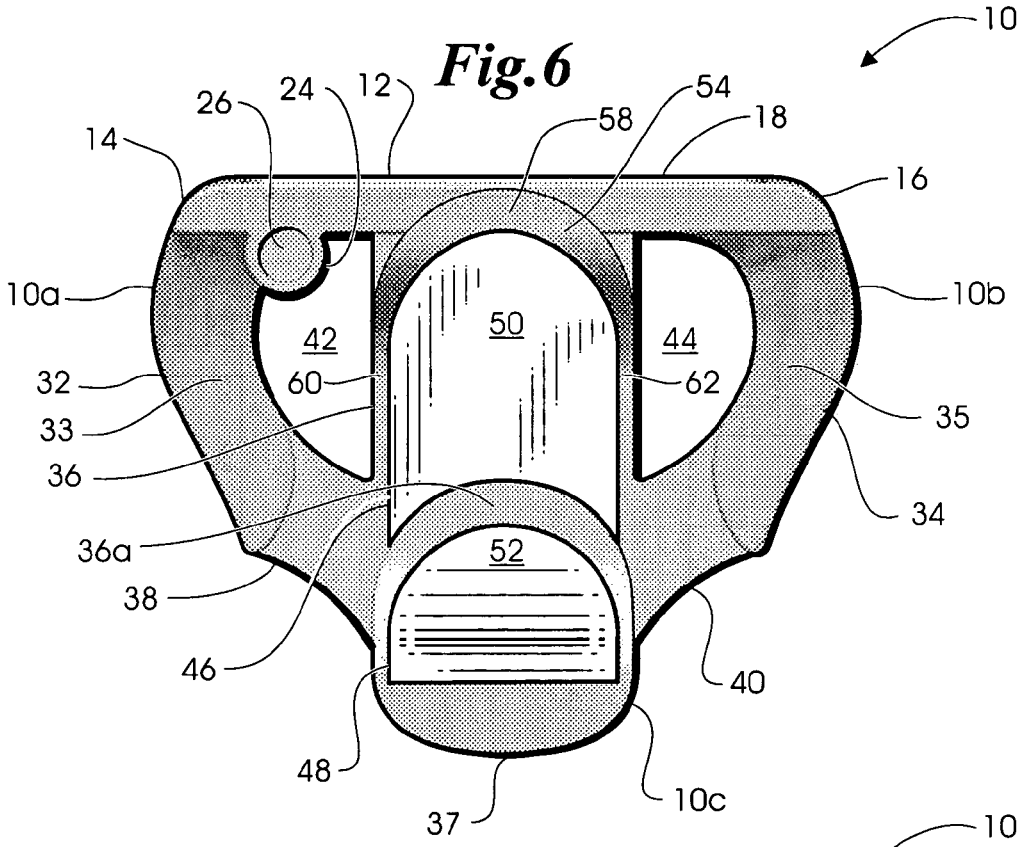
FIG. 6 is a top plan view of the golf putter head shown in FIG. 1.
Figure 7:
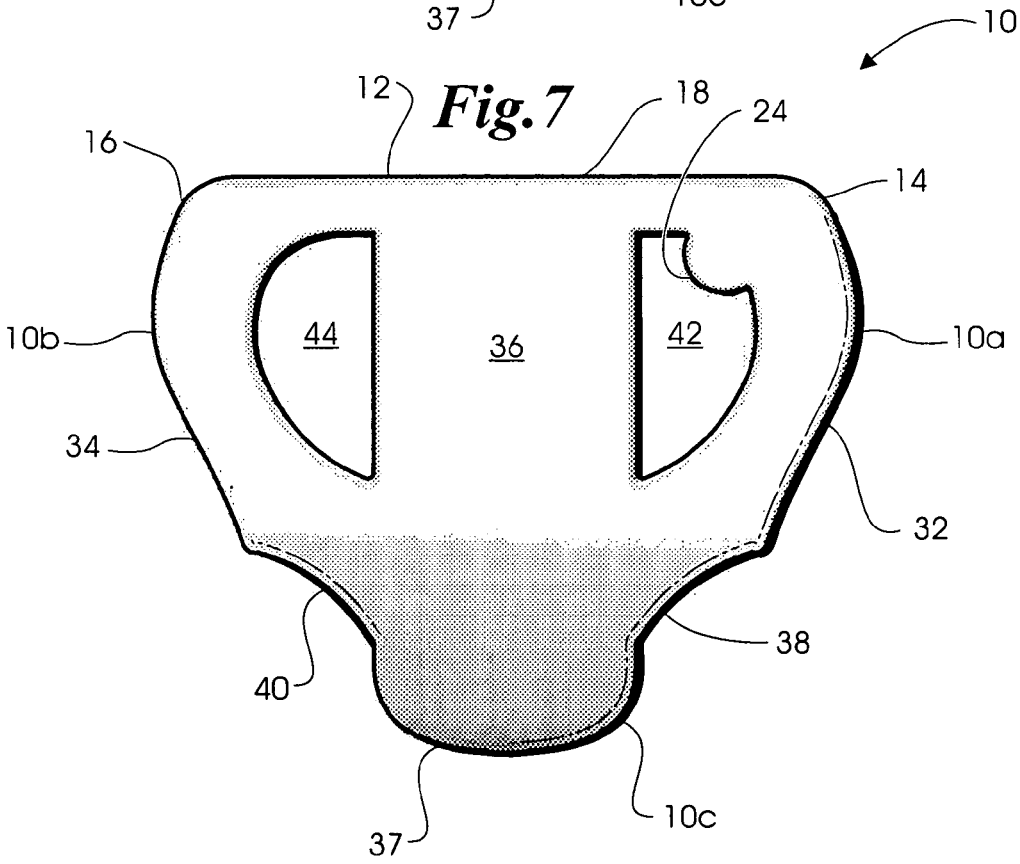
FIG. 7 is a bottom view of the golf putter head shown in FIG. 1.

As also shown in FIGS. 6 and 7, a first arm 32 extends substantially rearwardly from the heel end 14 of the face member 12 while a second arm 34 extends substantially rearwardly from the toe end 16 of the face member 12. A central member 36 extends rearwardly from the face member 12 intermediate the heel and toe ends 14, 16 thereof. The face member 12, the first and second arms 32, 34 and the central member 36 are preferably formed of a first material such as steel.

The central member 36 includes a pair of wing portions 38, 40 connecting the central member 36 to the first and second arms 32, 34 rearwardly of the face member 12. A first opening 42 is defined between the central member 36 and the first arm 32 adjacent the heel end 14 of the face member 12, and a second opening 44 is defined between the central member 36 and the second arm 34 adjacent the toe end 16 of the face member 12. These openings 42, 44 cause more weight to be located near end portions 10*a*, 10*b* and back portion 10*c* of the putter head 10 which increases the moment of inertia of the putter head 10. The central member 36 includes a thickened portion 37 adjacent putter head back portion 10*c*. This thickened portion 37 also causes more weight to be located near the back portion 10*c* of the putter head 10 further increasing the putter head moment of inertia.

A first cavity 46 having a depth of approximately 0.089 inch is formed in an upper surface 36*a* of the central member 36 between the openings 42, 44. A second cavity 48 having a depth of approximately 0.149 inch is formed in the upper surface 36*a* of the central member 36 rearwardly of the first cavity 46 and rearwardly of the openings 42, 44. First and second inserts 50 and 52 having respective thicknesses of approximately 0.074 and 0.134 inch are disposed, respectively, in the first and second cavities 46 and 48. Double sided adhesive tape (not shown) having a thickness of approximately 0.015 inch is used to secure the first and second inserts 50, 52 in the first and second cavities 46, 48. The first and second inserts 50, 52 are preferably formed of a second material, such as urethane, that is less dense than the first material from which the face member 12, the arms 32, 34 and the central member 36 are formed. The first cavity 46 and the first insert 50 each have a generally elongated crescent shape with a concave end while the second cavity 48 and the second insert 52 each have a generally semicircular shape with a convex side.

In order to provide a visual alignment aid, the convex sides of the second recess 48 and the second insert 52 are aligned with and complement the concave ends of the first recess 46 and the first insert 50. Since the first and second inserts 50, 52 are aligned in a direction that is substantially perpendicular to the front surface 18 of the face member 12, the visual alignment aid is lengthened. The first and second inserts 50, 52 have a color which contrasts with the face member 12, the first and second arms 32, 34 and the central member 36 to enhance the visual alignment aid.

The central member 36 has a substantially U-shaped wall 54 at one end thereof that merges with the back surface 20 of the face member 12. Formed at the other end of the central member 36 opposite the wall 54 is the thickened portion 37. The wall 54 has a top edge 56. A middle portion 58 of the wall top edge 56 is curved and protrudes slightly above the top rail 22 of the face member 12. As an alternative, the middle portion 58 of the top wall edge 56 may be recessed slightly below the top rail 22. Opposed side portions 60, 62 of the wall top edge 56 slope downwardly from the middle portion 58 as the wall 54 extends away from the face member 12. The arms 32, 34 have top surfaces 33, 35 that slope downwardly as the arms 32, 34 extend away from the face member 12.

Alternatively, the hosel 24 could be eliminated and a hole (not shown) could be formed in the arm 32 for receiving the lower end of the shaft 26. Also, the recess 28 and the face plate 30 could be eliminated from the front surface 18 of the face member 12.

What is claimed is:

1. A golf putter head comprising:

a face member having a heel end, a toe end, a top rail, and a front surface arranged for impacting a golf ball;

a first arm extending substantially rearwardly from the heel end of said face member;

a second arm extending substantially rearwardly from the toe end of said face member;

a central member extending rearwardly from said face member intermediate the heel and toe ends thereof, said central member being connected to said first and second arms rearwardly of said face member, said central member having an upper surface;

said central member and said first arm defining a first opening therebetween adjacent the heel end of said face member;

said central member and said second arm defining a second opening therebetween adjacent the toe end of said face member;

said central member including a first cavity in its upper surface located between said first and second openings; and said central member including a second cavity in its upper surface located rearwardly of said first cavity and rearwardly of said first and second openings.

2. The golf putter head of claim 1, wherein said central member includes a pair of wing portions connecting said central member to said first and second arms rearwardly of said face member.

3. The golf putter head of claim 1, wherein said first cavity has a generally elongated crescent shape with a concave end while said second cavity has a generally semicircular shape with a convex side.

4. The golf putter head of claim 3, wherein the convex side of said second cavity is aligned with and complements the concave end of said first cavity to provide a visual alignment aid.

5. The golf putter head of claim 4, further comprising:

said face member, said first and second arms, and said central member being made of a first material; and first and second inserts disposed, respectively, in said first and second cavities, said first and second inserts being made of a second material that is less dense than said first material.

6. The golf putter head of claim 5, wherein said first material is steel and said second material is urethane.

7. The golf putter head of claim 5, wherein said first and second inserts have a color which contrasts with said face member, said first and second arms and said central member to enhance said visual alignment aid.

8. The golf putter head of claim 7, wherein said first and second inserts are aligned in a direction that is substantially perpendicular to said face member thereby lengthening said visual alignment aid.

9. The golf putter head of claim 5, wherein said first and second cavities have respective depths of approximately 0.089 and 0.149 inch, and wherein said first and second inserts have respective thicknesses of approximately 0.074 and 0.134 inch.

10. The golf putter head of claim 3, further comprising a first insert disposed in said first cavity and having a generally elongated crescent shape with a concave end, and further comprising a second insert disposed in said second cavity and having a generally semicircular shape with a convex side.

11. The golf putter head of claim 10, wherein the convex side of said second insert is aligned with and complements the concave end of said first insert.

12. The golf putter head of claim 1, wherein said central member includes a substantially U-shaped wall at one end thereof that merges with a back surface of said face member.

13. The golf putter head of claim 12, wherein said arcuate wall has a top edge and wherein a middle portion of said wall top edge is curved and protrudes above the top rail on said face member.

14. The golf putter head of claim 13, wherein said wall top edge has opposed side portions which slope downwardly from said middle portion as said wall extends away from said face member.

15. The golf putter head of claim 14, wherein said first and second arms have top surfaces that slope downwardly as said first and second arms extend away from said face member.

16. The golf putter head of claim 12, wherein said central member has a thickened portion at the other end thereof opposite said arcuate wall.

17. A golf putter head comprising:

a face member having a heel end, a toe end, a top rail, a front surface arranged for impacting a golf ball, and a back surface;

a first arm extending substantially rearwardly from the heel end of said face member;

a second arm extending substantially rearwardly from the toe end of said face member;

a central member extending rearwardly from said face member intermediate the heel and toe ends thereof, said central member being connected to said first and second arms rearwardly of said face member;

said central member and said first arm defining a first opening therebetween adjacent the heel end of said face member;

said central member and said second arm defining a second opening therebetween adjacent the toe end of said face member; and said central member including a substantially U-shaped wall at one end thereof that merges with the back surface of said face member, said U-shaped wall including an arcuate wall having a top edge with a middle section of said U-shaped wall abutting the back surface of said face member and further including opposed side sections of said U-shaped wall extending from said middle section of said U-shaped wall and sloping downwardly from said top edge of said arcuate wall adjacent each of said first and second openings.

18. The golf putter head of claim 17, further comprising a face plate disposed in the front surface of said face member.

19. The golf putter head of claim 17, wherein said first and second openings define first and second open spaces, respectively, that are not closed off.

20. A golf putter head comprising:

a face member having a heel end, a toe end, a top rail, a front surface arranged for impacting a golf ball, and a back surface;

a first arm extending substantially rearwardly from the heel end of said face member;

a second arm extending substantially rearwardly from the toe end of said face member;

a central member extending rearwardly from said face member intermediate the heel and toe ends thereof, said central member being connected to said first and second arms rearwardly of said face member;

said central member including a substantially U-shaped wall at one end thereof that merges with the back surface of said face member, said U-shaped wall having a top edge with a middle portion that is curved and opposed side portions; and the middle portion of said U-shaped wall top edge protruding above the top rail of said face member, and the opposed side portions of said U-shaped wall top edge sloping downwardly as said U-shaped wall extends away from said face member.

21. The golf putter head of claim 20, wherein said first and second arms have top surfaces that slope downwardly as said first and second arms extend away from said face member.

22. The golf putter head of claim 21, wherein said central member has a thickened portion at the other end thereof apposite said U-shaped wall.

* * * * *